US007922464B2

(12) United States Patent
Adachi et al.

(10) Patent No.: US 7,922,464 B2
(45) Date of Patent: Apr. 12, 2011

(54) MAGNETIC DRIVE PUMP

(75) Inventors: Kazunari Adachi, Chiryu (JP); Takashi Sakumoto, Kariya (JP)

(73) Assignee: Aisin Seiki Kabushiki Kaisha, Aichi-ken (JP)

( * ) Notice: Subject to any disclaimer, the term of this patent is extended or adjusted under 35 U.S.C. 154(b) by 1026 days.

(21) Appl. No.: 11/783,576

(22) Filed: Apr. 10, 2007

(65) Prior Publication Data

US 2007/0243085 A1 Oct. 18, 2007

(30) Foreign Application Priority Data

Apr. 12, 2006 (JP) ..... 2006-109401
Nov. 2, 2006 (JP) ..... 2006-298329
Mar. 27, 2007 (JP) ..... 2007-081275

(51) Int. Cl.
*F04D 1/00* (2006.01)
*F04D 27/00* (2006.01)
*H02K 5/10* (2006.01)

(52) U.S. Cl. ..... 417/420; 417/223; 417/319; 310/104

(58) Field of Classification Search ..... 417/223, 417/319, 362, 420; 310/103, 104
See application file for complete search history.

(56) References Cited

U.S. PATENT DOCUMENTS 2,230,717 A * 2/1941 De Lancey ..... 417/223
3,411,450 A 11/1968 Clifton
3,458,122 A * 7/1969 Andriussi et al. ..... 416/170 R
5,066,200 A 11/1991 Ooka
6,997,688 B1 2/2006 Klein et al.
2004/0131485 A1 7/2004 Shi
2005/0095149 A1 5/2005 Tanaka et al.

FOREIGN PATENT DOCUMENTS

EP 0 512 516 A1 5/1992
JP 60-170476 2/1984
JP 2005-139917 11/2003

OTHER PUBLICATIONS

Extended European Search Report dated Sep. 12, 2007.

* cited by examiner

*Primary Examiner* — William H Rodriguez
*Assistant Examiner* — Philip Stimpert
(74) *Attorney, Agent, or Firm* — Stites & Harbison PLLC; Juan Carlos A. Marquez, Esq.

(57) ABSTRACT

A magnetic drive pump includes a pump chamber including an inlet port and an outlet port, a partition wall separating the pump chamber from an exterior, a rotational shaft provided at a side of the pump chamber relative to the partition wall, an impeller rotatably supported by a first end of the rotational shaft, an inductor integrally fixed to the impeller to rotate, a magnetic member positioned radially outside of the partition wall and facing the inductor, the magnetic member rotatably supported, a rotation drive device fixed to the magnetic means and actuating the magnetic member to rotate, and a drive device moving at least one of the magnetic member and the inductor in an axial direction of the rotational shaft.

15 Claims, 4 Drawing Sheets

MAGNETIC DRIVE PUMP

CROSS REFERENCE TO RELATED APPLICATIONS

This application is based on and claims priority under 35 U.S.C. §119 with respect to Japanese Patent Application No. 2006-109401 filed on Apr. 12, 2006, Japanese Patent Application No. 2006-298329 filed on Nov. 2, 2006, and Japanese Patent Application No. 2007-081275 filed on Mar. 27, 2007, the entire contents of which are incorporated herein by reference.

FIELD OF THE INVENTION

The present invention relates to a magnetic drive pump which drives an impeller to rotate by magnetic force.

BACKGROUND

A known magnetic drive pump described in JP2005-139917A discloses a water pump which includes an impeller rotatably supported in a pump chamber so as to generate a flow of the fluid in the pump chamber by the rotation thereof and a drive mechanism which rotates the impeller. The drive mechanism includes a permanent magnet integrally fixed to a drive magnet rotatably positioned outside relative to a partition wall which separates the pump chamber from the outside, and an inductor including a conductor which is rotated by the induced current generated by the rotation of the permanent magnet. With the construction of the water pump (i.e., the magnetic drive pump) described in JP2005-139917A, because a flow rate of the coolant (i.e., workload of the pump) increases nonlinearly in response to an increase of an engine rotation speed, the workload of the pump during high engine rotation speed can be appropriately set compared to the conventional water pump in which a flow rate of the coolant increases linearly. However, according to the construction of the water pump described in JP2005-139917A, in a middle engine rotation range, during cold start and warm up, or in an engine operation range in which not much circulation of the coolant is required such as when a vehicle travels in constant speed with small engine output, undue volume of the coolant is circulated, which is a cause of a decline of an engine warm-up performance and a decline of fuel economy because of unnecessary workload.

A need thus exists for a magnetic drive pump, which is capable of shortening a rise time of coolant temperature by declining a flow rate of coolant during cold start and warm up of, an engine and of improving fuel economy by reducing the workload of a pump by reducing the flow rate of coolant.

SUMMARY OF THE INVENTION

In light of the foregoing, the present invention provides a magnetic drive pump, which includes a pump chamber including an inlet port and an outlet port, a partition wall separating the pump chamber from an exterior, a rotational shaft provided at a side of the pump chamber relative to the partition wall, an impeller rotatably supported by a first end of the rotational shaft, an inductor integrally fixed to the impeller to rotate, a magnetic means positioned radially outside of the partition wall and facing the inductor, the magnetic means rotatably supported, a rotation drive means fixed to the magnetic means and actuating the magnetic means to rotate, and a drive means moving at least one of the magnetic means and the inductor in an axial direction of the rotational shaft.

BRIEF DESCRIPTION OF THE DRAWINGS

The foregoing and additional features and characteristics of the present invention will become more apparent from the following detailed description considered with reference to the accompanying drawings, wherein.

DETAILED DESCRIPTION

Figure 1:
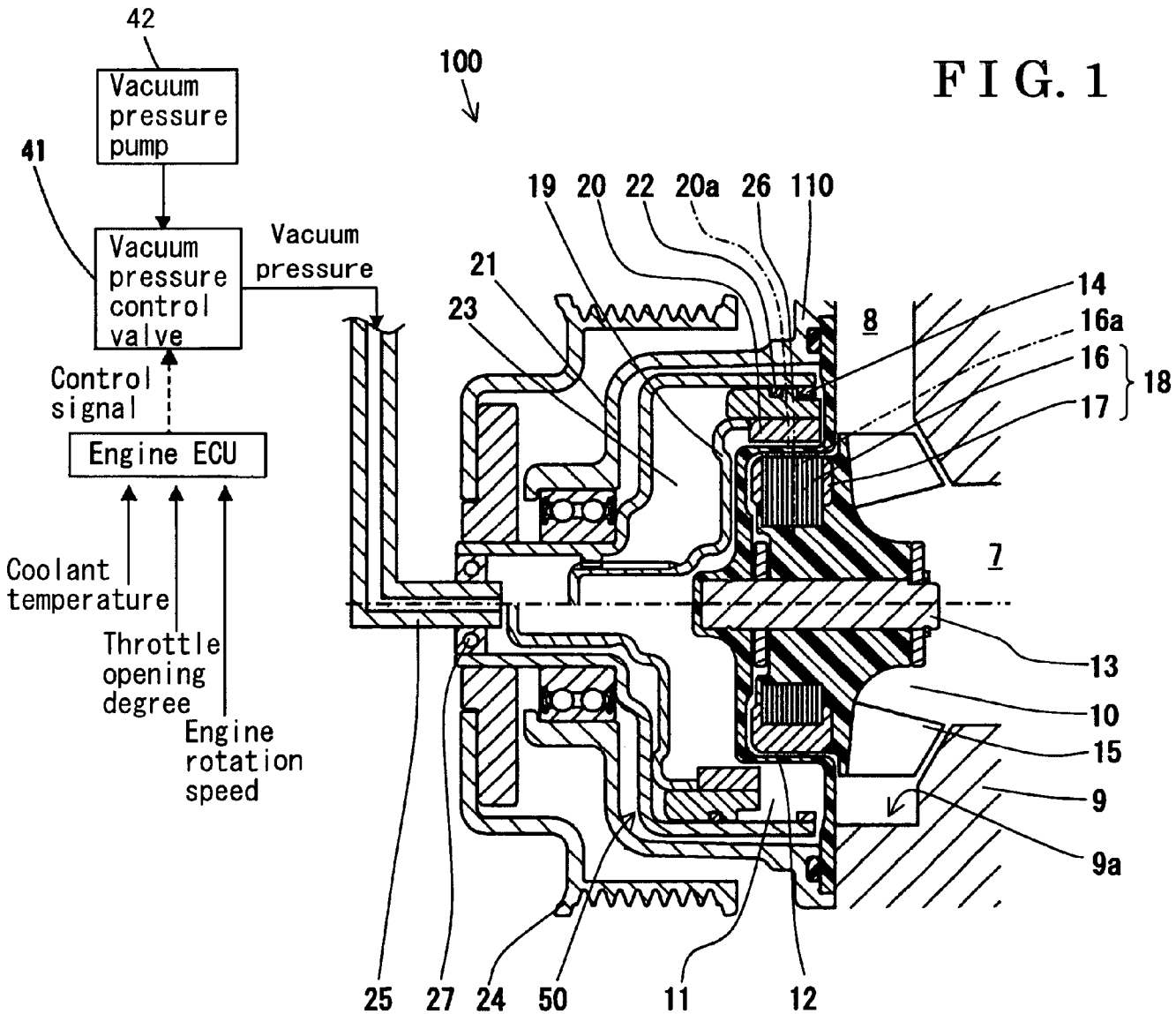
FIG. 1 is a cross-sectional view of a magnetic drive pump according to a first embodiment of the present invention.

Embodiments of the present invention will be explained with reference to illustrations of drawing figures as follows.

A first embodiment of the present invention will be explained referring to FIG. 1. A water pump (i.e., serving as a magnetic drive pump) 100 is fixed to an engine block 9 by means of a fastening means.

The water pump 100 includes an inlet port 7 and an outlet port 8 which are formed on the engine block 9, a body 110 which defines a pump chamber 10 by covering a recessed portion 9*a* formed on the engine block 9, an impeller 15 which is supported so as to rotate in the pump chamber 10 and to generate a flow of coolant in the pump chamber 10 by the rotation thereof, and a drive mechanism 50 which drives the impeller 15 to rotate.

A rotation shaft 13 is fixed to a partition wall 12 made from a non-magnetic material, which separates the pump chamber 10 formed at the engine block 9 from an outside portion (i.e., serving as exterior) 11. The impeller 15 is pivotally supported by the rotation shaft 13. A core 16, which is made from laminated plates, is integrally fixed to a backside of the impeller 15. The core 16 and an induction ring 17 form an inductor 18. A permanent magnet (i.e., serving as a magnetic means) 20 is positioned radially outside of the inductor 18 facing the inducer 18 intervened by the partition wall 12 therebetween. The permanent magnet 20 is divided into pieces in a circumferential direction and the north poles and the south poles are arranged alternately.

The permanent magnet 20 is fixed to an inner periphery of a ring shaped yoke 26, which is made from magnetic material, and is integrally formed with a cylindrical diaphragm 19 formed stepwise to have a shaft portion in the center thereof. The diaphragm 19 is made from non-magnetic material and is retained by an outer cylinder 21, which is formed stepwise, in a state where the diaphragm 19 is slidable in an axial direction. The diaphragm 19 and the outer cylinder 21 form a hermetically closed space (i.e., serving as a drive means) 23 which is configured to be airtight by a sealing member 22 provided on a sliding surface of the yoke 26.

A stopper 14 made from magnetic material is fixed to an open end of the outer cylinder 21 at a side of the impeller 15 so as to restrict the position of the permanent magnet 20 in an axial direction. The stopper 14 is arranged so as to contact with the yoke 26 to restrict the position of the permanent magnet 20 in the axial direction. In a state where the yoke 26 is in contact with the stopper 14, a center 16*a* of the core 16 in an axial direction is offset by a predetermined degree towards the impeller 15 relative to a center 20*a* of the permanent magnet 20.

The outer cylinder 21 includes a stepped shaft portion which has a smaller diameter at an opposite side of the impeller 15. A pulley (i.e., serving as a rotation drive means) 24 is integrally fixed onto the shaft portion of the outer cylinder 21. A vacuum pressure connector 25 is provided at an end of a bottom portion of the stepped shaft portion of the outer cylinder 21 via a bearing 27 which has the air tightness. The vacuum pressure connector 25 is connected to a vacuum pump 42, which is a vacuum source, via a vacuum pressure control valve 41. Alternatively, manifold air pressure of the engine may be used as the vacuum source.

An operation of the water pump 100 serving as the magnetic drive pump will be explained as follows.

An upper portion of a view in FIG. 1 shows a state of the water pump 100 where the vacuum pressure is not applied to the hermetically closed space 23 and a bottom portion of the view in FIG. 1 shows a state of the water pump 100 where the vacuum pressure is applied to the hermetically closed space 23.

In a state where the vacuum pressure is not applied, because the center 16*a* of the core 16 in the axial direction is offset by the predetermined degree to the impeller 15 side relative to the center 20*a* of the permanent magnet 20 in the axial direction, the permanent magnet 20 is attracted to be biased to the core 16 by the magnetic force so that the yoke 26 contacts the stopper 14. Because the stopper 14 and the yoke 16 are made from magnetic material, the stopper 14 and the yoke 16 attract each other by the magnetic force.

Upon a rotation of the pulley 24 by a rotation drive force transmitted from the engine via a belt, the outer cylinder 21 and the diaphragm 19 integrally rotate and a direction of magnetic flux between the permanent magnet 20 provided at the internal peripheral surface of the diaphragm 19 and inductor 18 changes in accordance with the rotation. In a state where the vacuum pressure is not applied to the hermetically closed state 23 (See the upper portion of the view in FIG. 1), the flux volume affecting between the permanent magnet 20 provided at the internal peripheral surface of the diaphragm 19 and the inductor 18 is maximized, the induced current generated at the inducer 18 by the changes of the magnetic flux direction is maximized, which maximizes the magnetic force, and thus a transmission torque by the magnetic induction is maximized. Accordingly, the rotational force of the impeller 15 is maximized to maximize the discharge performance of the pump.

On the other hand, in a state where the vacuum pressure is applied to the hermetically closed state 23 (see the bottom portion of the view in FIG. 1), because the diaphragm 19 is sucked in a direction to be away from the inductor 18 in an axial direction, the flux volume affecting between the permanent magnet 20 provided at the internal peripheral surface of the diaphragm 19 and the inductor 18 is minimized, the induced current generated at the inductor 18 by the changes of the magnetic flux direction is reduced, which reduces the magnetic force, and thus the transmission torque by the magnetic induction is reduced. Accordingly, the rotational force of the impeller 15 is reduced to lower the discharge performance of the pump.

Figure 2:
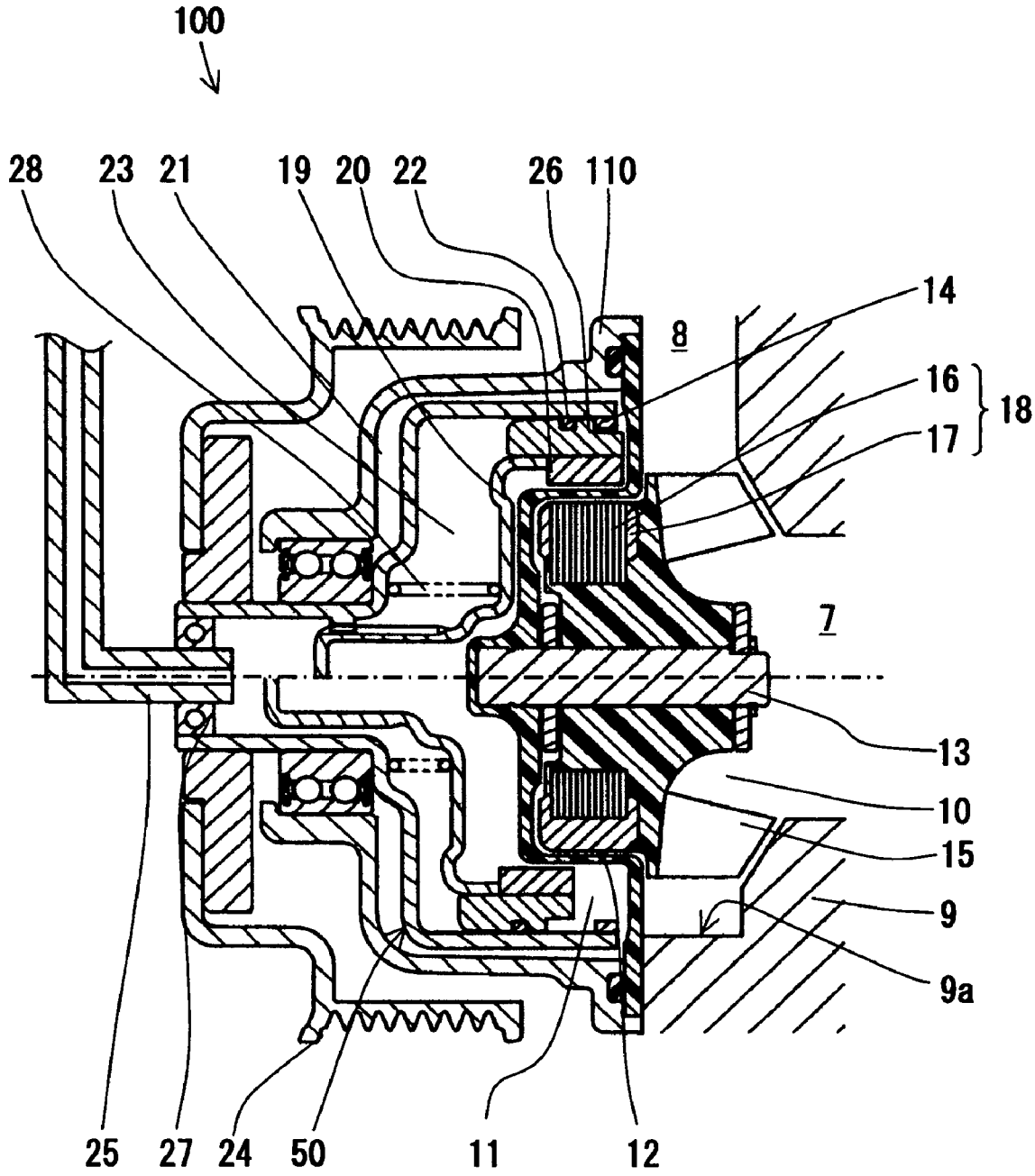
FIG. 2 is a cross-sectional view showing a modified example according to the first embodiment of the present invention.

When the application of the vacuum pressure is released from the state where the vacuum pressure is applied to the hermetically closed space 23 (shown at the lower portion of the view in FIG. 1), the permanent magnet 20 and the core 16 attract each other by the magnetic force so as to achieve a state where the vacuum pressure is not applied to the hermetically closed space 23 (shown at the upper portion of the view in FIG. 1). Further, as shown in FIG. 2, a spring 28, which biases the diaphragm 19 towards the impeller 15 for supplementing the attraction between the permanent magnet 20 and the core 16, may be provided in the hermetically closed space 23.

In case coolant performance is required such as when high level of load is applied to the engine or when the temperature of the coolant is high, the discharge performance of the pump is maximized without applying the vacuum pressure to the hermetically closed space 23. When the low or middle level of load is applied to the engine or when the temperature of the coolant is low, the vacuum pressure is applied to the hermetically closed space 23 to move the diaphragm 19 in the axial direction so as to reduce the excessive coolant flow and thus to reduce the drive force.

As explained above, with the construction of the magnetic drive pump according to the embodiment of the present invention, an engine control computer outputs a control signal to a vacuum pressure control valve on the basis of an engine rotation speed, the temperature of coolant, and throttle opening degree to control the vacuum pressure, and thus to optimally control the flow rate of the coolant to be constantly the minimum degree necessary.

Figure 4:
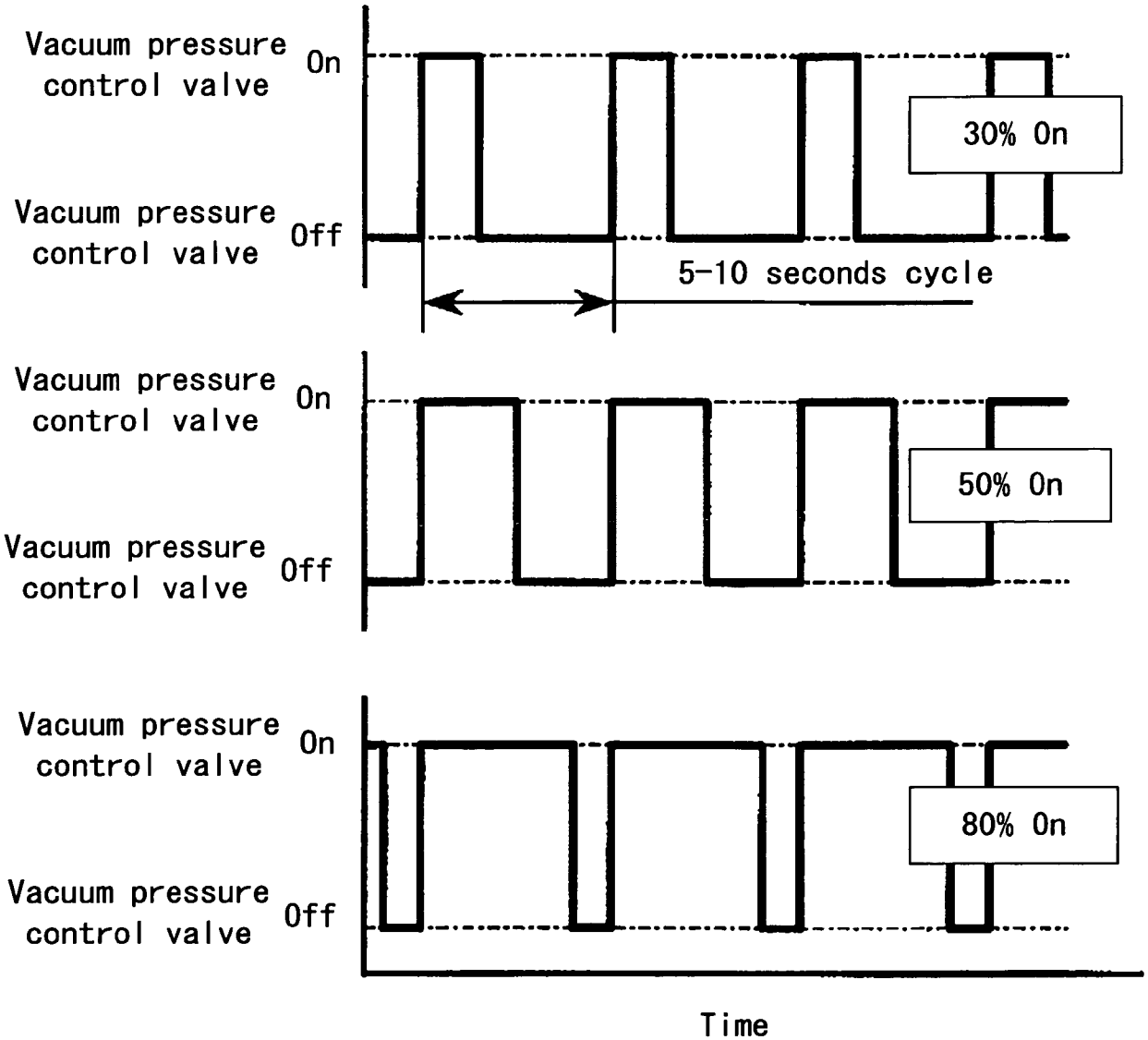
FIG. 4 is a view showing an example of operational pattern of the magnetic drive pump according to the first embodiment of the present invention.

Alternatively, instead of controlling the vacuum pressure per se, the vacuum pressure control valve may be controlled to repeat an operated state (i.e., ON time) and a non-operated state (i.e., OFF time) alternately within an arbitrary period in accordance with necessary flow rate, and an average flow rate within a predetermined time may be controlled. FIG. 4 shows an example of the foregoing alternative control. For example, by controlling the ON time to be 30 percent, 50 percent, or 80 percent of a predetermined time of 5-10 second cycle, an average flow rate within the predetermined time can be controlled to be 30 percent, 50 percent, or 80 percent of the maximum flow rate respectively.

Accordingly, with the construction of the magnetic drive pump according to the embodiment of the present invention, warm-up of the engine can be quickly achieved by reducing the flow rate of the coolant during engine cold starting and warm up, and simultaneously, output of unnecessary power is reduced to improve the fuel economy.

Figure 3:
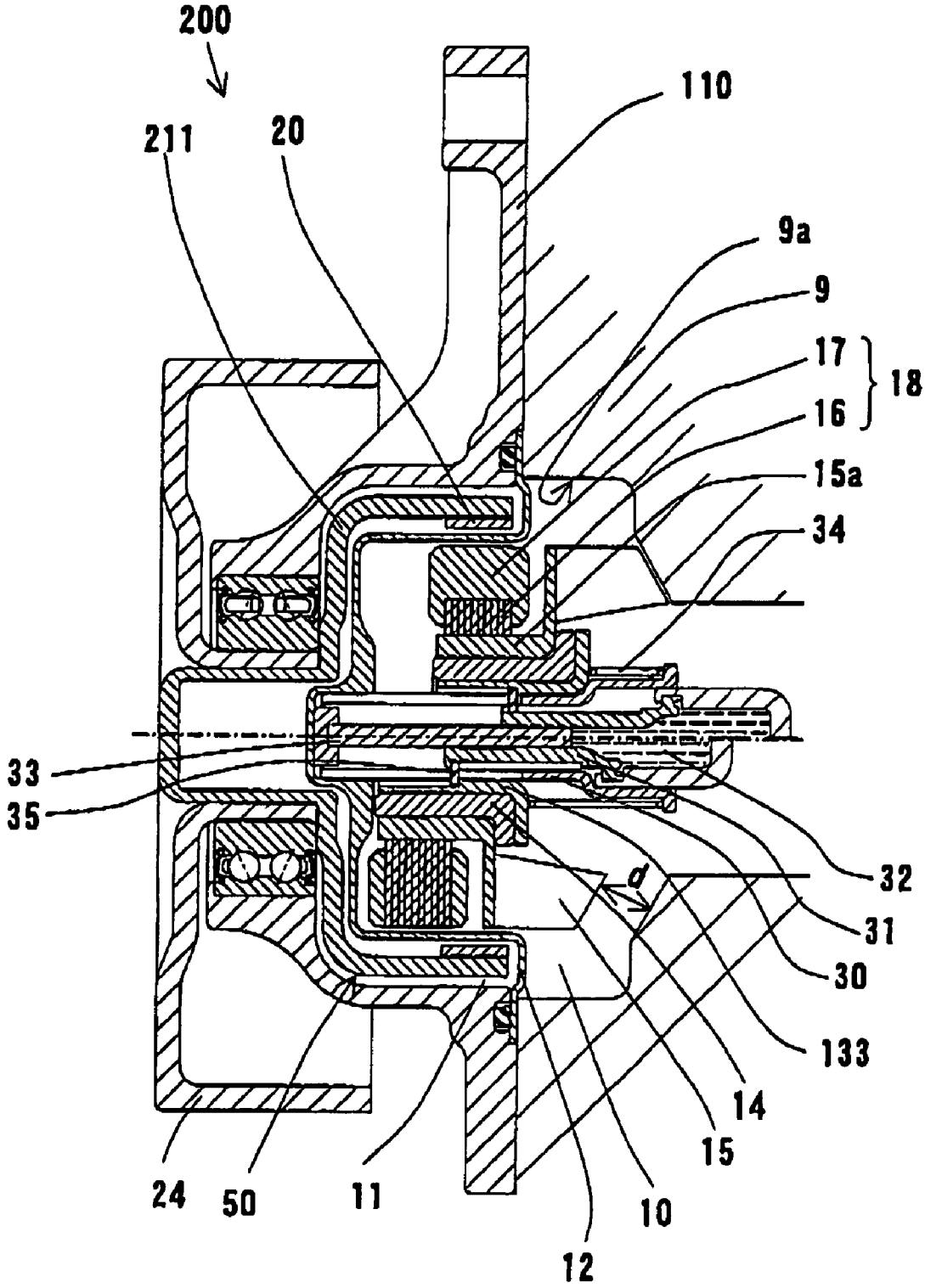
FIG. 3 is a cross-sectional view of a magnetic drive pump according to a second embodiment of the present invention.

A second embodiment of the present invention will be explained referring to FIG. 3. A water pump (i.e., serving as a magnetic drive pump) 200 is shown in FIG. 2. The same reference number is provided to the identical construction with the first embodiment and the explanation is not repeated.

As shown in FIG. 2, a cylindrical shaft 30 is fixed to a partition wall 12 which is made from non-magnetic material and is configured to separate a pump chamber 10 formed inside an engine block 9 from an outer portion 11. Thermowax (i.e., serving as a drive means; serving as a thermally actuated member; serving as a thermosensitive drive portion) 32 which is a thermosensitive member is sealed in the shaft 30. A slider 31 which supports a rod 33 configured to slide therein is provided in the shaft 30 so as to slide therein. A rotational shaft 133 is outfitted on an external periphery of the shaft 30 so as to slide in the axial direction. An impeller 15 is pivotally supported by the rotational shaft 133 via a bearing 14. A coil spring (i.e., serving as a thermosensitive drive portion; serving as an elastic member) 34 provided at an end portion of the shaft 30 biases the rotational shaft 133 in a direction to be away from a tip end of the shaft 30. When the thermowax 32 expands, the slider 31 is pushed in an axial direction by the rod 33 which is in contact with the partition wall 12, and the rotational shaft 133 is pushed in the axial direction by a pin 35 which protrudes from the slider 31 in a radial direction.

A core 16, which is made from laminated plates, is integrally fixed on an external periphery of a back surface shaft portion 15*a* of the impeller 15. The core 16 and an induction ring 17 form an inductor 18. A permanent magnet (i.e., serving as a magnetic means) 20 is provided on an internal periphery of an outer cylinder 211 which is shaped in a cylinder having a bottom. The permanent magnet 20 is arranged radially outside of the inductor 18 intervened by the partition wall 12 therebetween. The outer cylinder 211 includes a stepped shaft portion at a bottom portion to which a pulley (i.e., serving as a rotation drive means) 24 is integrally fixed.

An operation of the water pump (the magnetic drive pump) 200 according to the second embodiment of the present invention will be explained as follows.

An upper portion of a view in FIG. 2 shows a state of the water pump 200 where the coolant temperature is high and a bottom portion of the view in FIG. 2 shows a state of the water pump 200 where the coolant temperature is low.

Upon a rotation of the pulley 24 by a rotation drive force transmitted from an engine via a belt, the outer cylinder 211 rotates and the direction of the magnetic flux between the permanent magnet 20 provided at the internal peripheral surface of the outer cylinder 211 and the inductor 18 changes.

In a state where the temperature of the coolant is low, the slider 31 is positioned closer to the pulley 24 because the thermowax 32 is contracted. In this state, because the rotational shaft 133 is also biased by the coil spring 34 towards the pulley 24, the inductor 18 and the permanent magnet 20 are positioned so as not to face each other and the flux volume affecting between the permanent magnet 20 and the inductor 18 is minimized, the induced current generated at the inductor 18 by the changes of the flux direction is reduced, and thus the transmission torque by the magnetic induction is lowered. Namely, in the state where the temperature of the coolant is low, the rotational force of the impeller 15 is reduced to lower the discharge performance of the pump. Further, in this state, because a tip end of the impeller 15 and the engine block 9 is away from each other (i.e., distance d is long), the discharge volume of the pump 200 is further reduced and a flow rate of the coolant is reduced so that the engine can warm up quickly.

When the temperature of the coolant rises under the warmed up state of the engine, the thermowax 32 expands to move the slider 31 towards the engine block 9 in an axial direction. Because the pin 35 protruded from the slider 31 in the radial direction pushes the rotational shaft 133 towards the engine block 9 in the axial direction against a biasing force of the coil spring 34, the inductor 18 is moved along with the rotational shaft 133 to come to the position facing the permanent magnet 20. In those circumstances, the flux volume affecting between the inductor 18 and the permanent magnet 20 is maximized, the induced current generated at the inductor 18 by the change of the flux direction is maximized, which maximizes the magnetic force, and thus the transmission torque by the magnetic induction is maximized. Simultaneously, because the distance d between the tip end of the impeller 15 and the engine block 9 is minimized to maximize the discharge volume of the pump 200, the engine can be appropriately cooled by adequate amount of coolant.

According to the embodiments of the present invention, by providing the drive means which moves at least one of the magnetic means or the inductor in an axial direction of the rotational shaft in a magnetic driven water pump, the magnetic force generated between the magnetic means and the inductor can be controlled. Namely, during the engine cold starting and warming up when the temperature of the coolant is low, rotation speed of the impeller which rotates integrally with the inductor is reduced by reducing the magnetic force generated between the magnetic means and the inductor, the rise time of the coolant temperature is shortened by reducing the flow rate of the coolant, and the engine load is reduced to improve the fuel economy.

According to the embodiments of the present invention, because the drive means includes the hermetically closed space which changes volume in response to a change of internal pressure applied thereto, at least one of the magnetic means or the inductor can be moved by a simple structure, and the magnetic force generated between the magnetic means and the inductor can be controlled.

According to the embodiments of the present invention, by operating the drive means using the pressure, at least one of the magnetic means or the inductor can be moved by the vacuum pressure, and the magnetic force generated between the magnetic means and the inductor can be controlled.

According to the embodiments of the present invention, by operating the drive means by the vacuum pressure of the drive means, there is degree of freedom of arrangement of the vacuum pump serving as a vacuum source in an engine room.

According to the embodiment of the present invention, because the discharge volume by the pump is controlled in response to time distribution of operation and non-operation of the drive means per unit of time, an optimum discharge volume by the pump is controlled in accordance with the states such as warmed-up state of the engine and states such as load applied to the engine.

According to the embodiment of the present invention, by including the thermosensitive drive member, which is provided in the rotational shaft and expands and contracts in response to the temperature of the coolant, in the drive means, a flow rate of the coolant can be controlled based on the temperature of the coolant.

According to the embodiment of the present invention, by including the thermally actuated member and the elastic member in the thermosensitive drive member, a flow rate of the coolant can be controlled with a simple structure.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

The invention claimed is:

1. A magnetic drive pump, comprising:

a pump chamber including an inlet port and an outlet port;

a partition wall separating the pump chamber from an exterior;

a rotational shaft provided at a side of the pump chamber relative to the partition wall;

an impeller rotatably supported by a first end of the rotational shaft;

an inductor integrally fixed to the impeller to rotate;

a magnetic means positioned radially outside of the partition wall and facing the inductor, the magnetic means rotatably supported;

a rotation drive means fixed to the magnetic means and actuating the magnetic means to rotate; and a drive means moving at least one of the magnetic means and the inductor in an axial direction of the rotational shaft, the drive means including a hermetically closed space which changes volume in response to a change of internal pressure applied thereto, the hermetically closed space comprising an outer cylinder, an inner diaphragm having a first end portion fitted for axial movement into a first end portion of the outer cylinder, and a yoke fixed to a second end portion of the inner diaphragm, the yoke having an outer surface in fluid-tight sliding engagement with an inner surface of the outer cylinder at a second end portion of the outer cylinder, the yoke having an inner surface connecting to the magnetic means, the magnetic means being formed in a ring-shaped configuration.

2. The magnetic drive pump according to claim 1, wherein the drive means is operated by a pressure.

3. The magnetic drive pump according to claim 1, wherein the drive means is operated by a vacuum pressure of a vacuum pump.

4. The magnetic drive pump according to claim 1, wherein a discharged volume of fluid by the pump is controlled in response to time distribution of an operation and non-operation of the drive means per unit time.

5. The magnetic drive pump according to claim 1, wherein the second end portion of the inner diaphragm is co-axially arranged with respect to the magnetic means.

6. A magnetic drive pump, comprising:

a pump chamber including an inlet port and an outlet port;

a partition wall separating the pump chamber from an exterior;

a rotational shaft provided at a side of the pump chamber relative to the partition wall;

an impeller rotatably supported by a first end of the rotational shaft;

an inductor integrally fixed to the impeller to rotate;

a magnetic means positioned radially outside of the partition wall and facing the inductor, the magnetic means rotatably supported;

a rotation drive means fixed to the magnetic means and actuating the magnetic means to rotate; and a drive means moving at least one of the magnetic means and the inductor in an axial direction of the rotational shaft, the drive means being operated by a vacuum pressure of a vacuum pump.

7. The magnetic drive pump according to claim 6, wherein the drive means includes a hermetically closed space which changes volume in response to a change of internal pressure applied thereto.

8. The magnetic drive pump according to claim 6, wherein the drive means is operated by a pressure.

9. The magnetic drive pump according to claim 6, wherein a discharged volume of fluid by the pump is controlled in response to time distribution of an operation and non-operation of the drive means per unit time.

10. The magnetic drive pump according to claim 7, wherein the hermetically closed space comprises an outer cylinder, an inner diaphragm fitted at its one end portion for axial movement into one end portion of the outer cylinder, and a yoke fixed to the other end portion of the inner diaphragm, the yoke being at its outer surface in fluid-tight sliding engagement with the other end portion of the inner surface of the outer cylinder, the yoke connecting at its inner surface the magnet means which is formed in an ring-shaped configuration.

11. The magnetic drive pump according to claim 10, wherein the other end portion of the inner diaphragm and the magnetic means are in co-axial arrangement.

12. A magnetic drive pump, comprising:

a pump chamber including an inlet port and an outlet port;

a partition wall separating the pump chamber from an exterior;

a rotational shaft provided at a side of the pump chamber relative to the partition wall;

an impeller rotatably supported by a first end of the rotational shaft;

an inductor integrally fixed to the impeller to rotate;

a magnetic means positioned radially outside of the partition wall and facing the inductor, the magnetic means rotatably supported;

a rotation drive means fixed to the magnetic means and actuating the magnetic means to rotate; and a drive means moving at least one of the magnetic means and the inductor in an axial direction of the rotational shaft, the drive means including a thermosensitive drive portion provided in the rotational shaft and expanded and contracted in response to temperature of coolant.

13. The magnetic drive pump according to claim 12, wherein a discharged volume of fluid by the pump is controlled in response to time distribution of an operation and non-operation of the drive means per unit time.

14. The magnetic drive pump according to claim 12, wherein the thermosensitive drive member includes a thermally actuated member and an elastic member.

15. The magnetic drive pump according to claim 12, wherein the other end portion of the inner diaphragm and the magnetic means are in co-axial arrangement.

* * * * *